US005303745A

United States Patent [19]

Kaufmann et al.

[11] Patent Number: 5,303,745

[45] Date of Patent: Apr. 19, 1994

[54] WEAVING MACHINE WITH WEFT BREAK CLEARING DEVICES

[75] Inventors: Josef Kaufmann, Elsau; Heinz Pfenninger, Volketswil, both of Switzerland

[73] Assignee: Sulzer Brothers Limited, Winterhur, Switzerland

[21] Appl. No.: 864,780

[22] Filed: Apr. 7, 1992

[30] Foreign Application Priority Data

Jun. 11, 1991 [CH] Switzerland ..... 01742/91

[51] Int. Cl.[5] ..... D03D 47/34

[52] U.S. Cl. ..... 139/116.2; 139/450

[58] Field of Search ..... 139/116.2, 450, 1 C

[56] References Cited

U.S. PATENT DOCUMENTS 3,396,755 8/1968 Nichols et al. ..... 139/450 X
4,664,157 5/1987 Shin .
4,676,277 6/1987 Gillespie et al. ..... 139/1 C
4,749,006 6/1988 Miyamoto .
4,858,656 8/1989 Suwa ..... 139/116.2
4,899,788 2/1990 Aarts ..... 139/116.2

FOREIGN PATENT DOCUMENTS 0236597 9/1987 European Pat. Off. .
0340721 11/1989 European Pat. Off. .

*Primary Examiner*—Andrew M. Falik
*Attorney, Agent, or Firm*—Townsend and Townsend Khourie and Crew

[57] ABSTRACT

A weaving machine, more particularly a projectile weaving machine (100), has weft break clearing devices (1, 2) at the shed entrance and exit. These devices form units with grippers and, for example, a suction device for removing a broken weft (110) and are mounted for pivoting or displacing them with an actuator or manually out of range of the warps. The mobility of the devices (1, 2) allows the weaver unrestricted access, for example, when clearing a warp break in the selvedge area.

9 Claims, 1 Drawing Sheet

WEAVING MACHINE WITH WEFT BREAK CLEARING DEVICES

BACKGROUND OF THE INVENTION

The invention relates to a weaving machine, more particularly a projectile weaving machine, having at least one weft break clearing device located at the entrance to or an exit of a shed of the machine for gripping and weaving broken weft yarn.

Various devices and methods are known by means of which faulty picks and weft breaks can be cleared, such as with an air jet or gripper weaving machines (see for example EP-AS 0332257). Weft break clearing devices are composed of sensors, gripping means, hooks, suction nozzles and/or draw-off rollers. These devices make it possible in many cases for the break to be cleared automatically by the weaving machine itself. As a rule it is not possible to clear every type of fault automatically. If a fault of this kind arises, the weaver must intervene. At this point a disadvantage of the weft break clearing devices become apparent, in that these devices disturb or hinder the weaver in his work.

SUMMARY OF THE INVENTION

An object of the invention is to create features by means of which hindrance by the weft break clearing devices during manual intervention in the weaving machine is eliminated or at least reduced. This object is achieved by constructing the broken weft gripping and removing device so that it can be displaced out of range of the warps, either manually or automatically. Preferably, the broken weft clearing device is constructed as a flexible tube which integrates a suction duct with control cables and power supply leads.

DESCRIPTION OF THE PREFERRED EMBODIMENTS

Figures 1, 2:
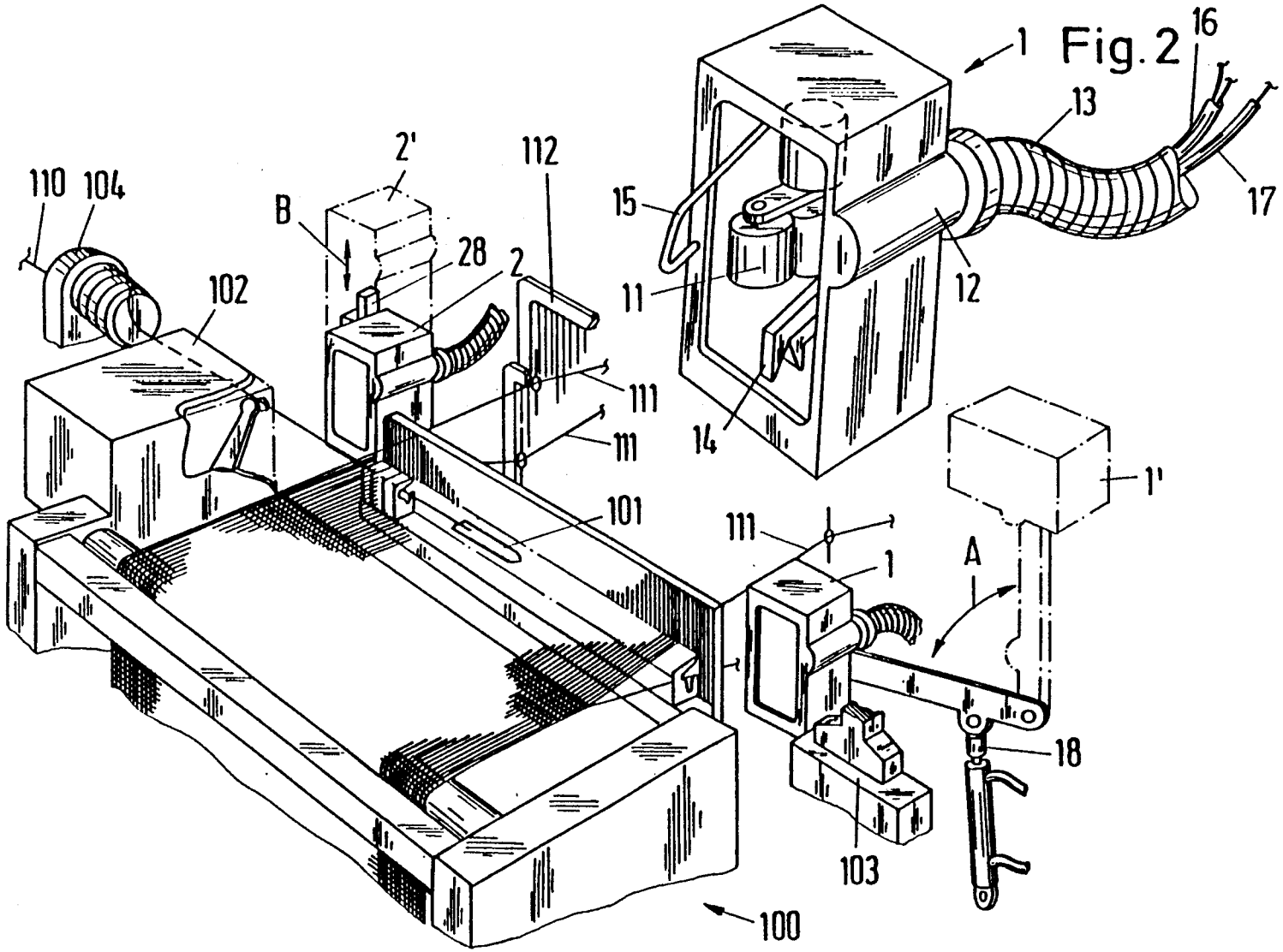
FIG. 1 illustrates a projectile weaving machine with weft break clearing devices in accordance with the invention.
FIG. 2 illustrates a weft break clearing device in more detail.

In the projectile weaving machine 100 shown in FIG. 1 the following components bear reference numerals: the weft break clearing devices 1 and 2, the projectile 101, the picking mechanism 102, the projectile brake 103 of the catcher (not shown), the storage means 104 for the weft yarn 110, warp yarns 111, and heald shafts or heddles 112.

In accordance with the invention the weft break clearing devices 1 and 2 situated at the shed exit and entrance respectively are units which can be pivoted or displaced out of range of the warp yarns. These units are preferably compact in construction. The device 1 can be pivoted upwards by a drive 18 into a position 1' (double arrow A). The device 2 can be moved vertically by a drive 28 into a position 2' (double arrow B). This displacement may alternatively, of course, take place in a direction inclined to the vertical.

The weft break clearing device 1 shown in FIG. 2 is to be regarded, in spite of the representation of details, merely as a diagrammatic example. The following components are illustrated: a pair of take-off rollers 11, a suction duct 12, a flexible connecting tube 13, gripping means 14 and a hook 15. When a weft breaks, the gripping means 14 and hook 15, which are movable by drives (not shown), lead the yarn to be removed between the two rollers 11 and up to the intake (not visible) of the suction duct 12. The continuation of the suction duct 12 and advantageously a connecting tube 13 includes a power supply lead 16 for supplying power to each weft break clearing device 1, 2 and a control cable 17 for operating drives 18, 28.

The weft break clearing devices 1 and 2 are movable automatically; it is convenient if they are also movable manually. Advantageously, they can be lifted over the heald shafts to give unimpeded access to the set of shafts (not shown). In the event of warp breakage in the selvedge area the break clearing to be carried out by the weaver is accelerated if the weft break clearing device 1 or 2 moves out of range of the warps automatically, as soon as the weaving machine stops due to the warp break and the warp break in the selvedge area is registered.

The invention, which has been described with reference to a projectile weaving machine, can also be applied to air-jet and gripper weaving machines. In addition it is possible for a weft break clearing device with the inventive features to be provided on only one side, at the shed entrance or exit.

What is claimed is:

1. A weaving machine for weaving cloth formed of longitudinal warps and transverse weft yarn, the machine comprising a shed having an entrance and an exit, a weft yarn break clearing device positioned at at least one of the shed entrance and shed exit, and means for gripping and removing a broken weft yarn, including a flexible connecting tube for withdrawing the defective weft yarn from the machine.

2. A weaving machine as claimed in claim 7 wherein the gripping and removing means includes means for automatically displacing the device.

3. A weaving machine as claimed in claim 1 including a heald shaft, and wherein the displacing means includes means for moving the clearing device over the heald shaft to provide unimpeded access to the heald shafts.

4. A weaving machine as claimed in claim 1 comprising a projectile weaving machine including a projectile for the weft yarn.

5. A weaving machine as claimed in claim 1 wherein the removing means includes means for manually displacing the weft break clearing device.

6. A weaving machine as claimed in claim 2 wherein the displacing means includes a drive pivotably coupled to the weft break clearing device, the drive configured to displace the device vertically and horizontally.

7. A weaving machine as claimed in claim 2 wherein the displacing means includes a drive configured to displace the device in a vertical direction.

8. A weaving machine for weaving cloth formed of longitudinal warps and transverse weft yarn, the machine comprising a shed having an entrance and an exit, a weft yarn break clearing device positioned at at least one of the shed entrance and shed exit, and means for removing a broken weft yarn, including a flexible connecting tube for withdrawing the defective weft yarn from the machine, the flexible tube including a suction duct for the withdrawal of the defective weft yarn, a power supply lead and a control cable for the weft break clearing device.

9. A weaving machine comprising a shed having an entrance and an exit, heald shafts, a weft break clearing device including means for gripping and removing a broken weft yarn from the machine comprising:

a flexible connecting tube including a suction duct for withdrawal of a defective weft yarn, a control cable, and a power supply lead; and means for displacing the clearing device from proximate the warps and over the heald shafts to provide unimpeded access to the heald shafts.

* * * * *